US006357915B2

(12) United States Patent
Anderson

(10) Patent No.: US 6,357,915 B2
(45) Date of Patent: Mar. 19, 2002

(54) STORAGE BAG WITH ONE-WAY AIR VALVE

(75) Inventor: Brent G. Anderson, Barrington, IL (US)

(73) Assignee: New West Products, Inc., San Diego, CA (US)

( * ) Notice: Subject to any disclaimer, the term of this patent is extended or adjusted under 35 U.S.C. 154(b) by 0 days.

(21) Appl. No.: 09/891,812

(22) Filed: Jun. 25, 2001

Related U.S. Application Data

(63) Continuation-in-part of application No. 09/630,038, filed on Aug. 1, 2000, which is a continuation-in-part of application No. 09/374,484, filed on Aug. 13, 1999, now Pat. No. 6,116,781.

(51) Int. Cl.[7] ..... B65D 33/01

(52) U.S. Cl. ..... 383/100; 206/524.8; 383/44; 493/213

(58) Field of Search ..... 383/100, 44; 206/524.8; 493/213

(56) References Cited

U.S. PATENT DOCUMENTS

| | | | | |
|---|---|---|---|---|
| 2,595,708 A | | 5/1952 | Salfisberg | |
| 3,102,676 A | | 9/1963 | Danelli et al. | |
| 3,214,082 A | | 10/1965 | Celentano | |
| 3,381,887 A | | 5/1968 | Lowry | |
| 3,516,217 A | | 6/1970 | Gildersleeve | |
| 3,646,856 A | | 3/1972 | Worndl | |
| 3,785,111 A | | 1/1974 | Pike | |
| 4,557,377 A | * | 12/1985 | Maloney | 206/219 |
| 4,834,554 A | | 5/1989 | Stetler, Jr. et al. | |
| 5,240,112 A | | 8/1993 | Newburger | |
| 5,351,828 A | * | 10/1994 | Becker et al. | 383/44 |
| 5,540,500 A | | 7/1996 | Tanaka | |
| 5,558,441 A | * | 9/1996 | Morrison et al. | 383/100 |
| 5,701,996 A | | 12/1997 | Goto et al. | |
| 5,881,881 A | | 3/1999 | Carrington | |
| 5,894,929 A | | 4/1999 | Kai et al. | |
| 5,973,768 A | | 10/1999 | Mazion et al. | |
| 6,116,781 A | | 9/2000 | Skeens | |

FOREIGN PATENT DOCUMENTS

| | | |
|---|---|---|
| JP | 5-178354 A | 7/1993 |
| JP | 5-338657 * | 12/1993 |

* cited by examiner

*Primary Examiner*—Stephen P. Garbe
(74) *Attorney, Agent, or Firm*—Skjerven Morrill MacPherson LLP; Christopher B. Allenby

(57) ABSTRACT

A flexible, evacuable storage bag has a storage portion, an airtight seal, and a one-way valve. The valve includes a strip sandwiched between top and bottom sheets used to make the bag. The strip is bonded along the edges to the top and bottom sheets so as to form a single passageway extending from the storage portion to outside the bag.

14 Claims, 6 Drawing Sheets

STORAGE BAG WITH ONE-WAY AIR VALVE

RELATED APPLICATIONS

This application is a continuation-in-part of application Ser. No. 09/630,038, filed Aug. 1, 2000 by Janet L. Skeens and Brent G. Anderson, and entitled "Storage Bag With One-Way Air Valve," which is a continuation-in-part of application Ser. No. 09/374,484, filed Aug. 13, 1999 now U.S. Pat No. 6,116,781 by Janet L. Skeens and Brent G. Anderson and entitled "Storage Bag With One-Way Air Valve."

BACKGROUND

1. Field of Invention

The present invention relates to storage bags, and in particular to reusable evacuable storage bags with integral one-way air valves.

2. Related Art

Evacuable flexible storage bags allow a user to compress and subsequently store and carry bulky items, e.g., clothing. Such bags are typically made of plastic and include an airtight seal. After placing one or more items inside the bag, the user partially closes the seal. The user then presses on the bag to force air through the remaining opening in the seal. Once air is forced through the opening, the user fully closes the seal and the stored items remain compressed by ambient air pressure. However, such bags are difficult to use.

One problem with many current airtight storage bags is that some air may leak back into the bag as the user attempts to close the seal. Another problem is that forces on the bag during compressing tend to fully open the partially closed seal, thus requiring the user to fully close the seal once the bag is compressed. Yet another problem is that many users find it awkward to maintain compression force on the bag while fully closing the seal. Still another problem is low cabin pressure during air travel may cause air inside the bag to expand and open the seal.

One solution is to equip an airtight storage bag with a one-way air valve. The valve allows the user to force air out of, but prevents air from reentering, the bag. U.S. Pat. No. 5,540,500 discloses a sealed bag including a check valve. The '500 patent discloses a check valve including at least two rectangular plastic films. The plastic films are bonded together to form a flat pipe that extends between the storage bag body and a covering envelope. However, articles placed in the bag may fold the pipe back on itself and block the valve. And the covering envelope is required to protect the valve portion extending from the bag body.

What is required is a simpler one-way check valve that is more reliable, and is easier and more economical to manufacture.

SUMMARY

In accordance with the invention, a flexible, evacuable storage bag includes a one-way air valve that has a single strip bonded between the top and bottom sheets used to make the bag. The bag also includes an airtight seal through which the user places one or more items to be stored into the bag.

The valve strip is sandwiched between the top and bottom sheets. In one case the strip is bonded along the strip's edges to the top and bottom sheets to form two passageways. In another case the strip is bonded along the strip's edges to form a single passageway. The passageways extend from the storage portion of the bag to the outside.

The user may, for example, insert one or more items to be stored through the opening and closes the airtight seal. The user then puts pressure on the bag to force air from a storage portion through the valve to the outside. Once air has been evacuated from the bag, ambient pressure holds the top and bottom sheets against the valve strip to prevent air from returning to the bag.

DETAILED DESCRIPTION

Figure 1:
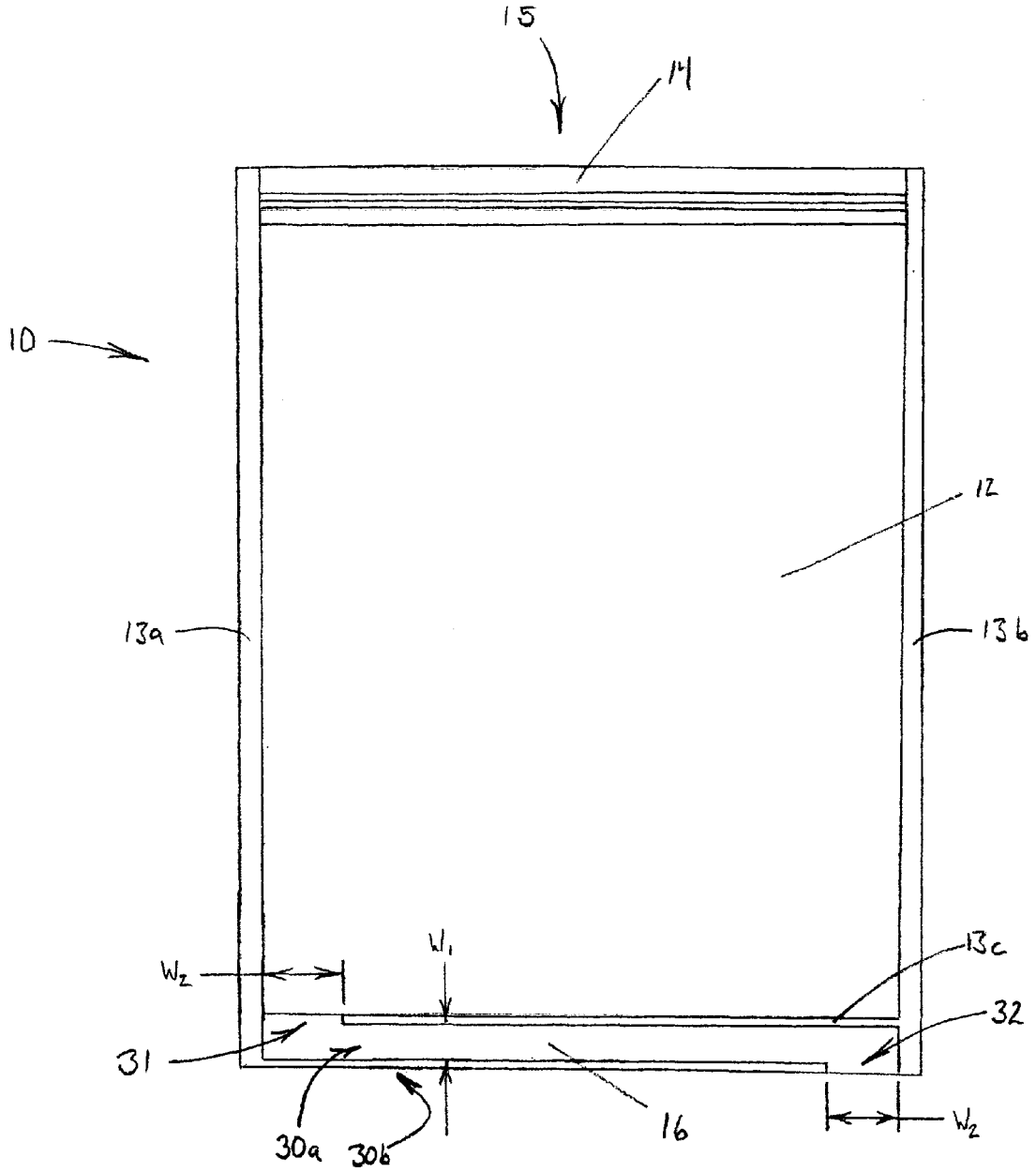
FIG. 1 is a plan view of an embodiment of the invention.

FIG. 1 is a plan view of a flexible storage bag 10 in accordance with the invention. As shown, bag 10 has a storage portion 12 formed by bonding two flexible plastic sheets along edges 13*a*, 13*b*, and 13*c*. FIG. 1 shows bag 10 as rectangular, although other embodiments may have other shapes. Airtight seal 14 is placed in opening 15 between the two sheets. When seal 14 is open, a user places one or more items to be stored through opening 15 into storage portion 12 and then closes seal 14. A valve 16 allows air to pass in one direction from storage portion 12 to outside bag 10. As shown, valve 16 is positioned along edge 13*c* of storage portion 12, opposite seal 14, but in other embodiments valve 16 may be placed along another edge of storage portion 12.

Figure 2:
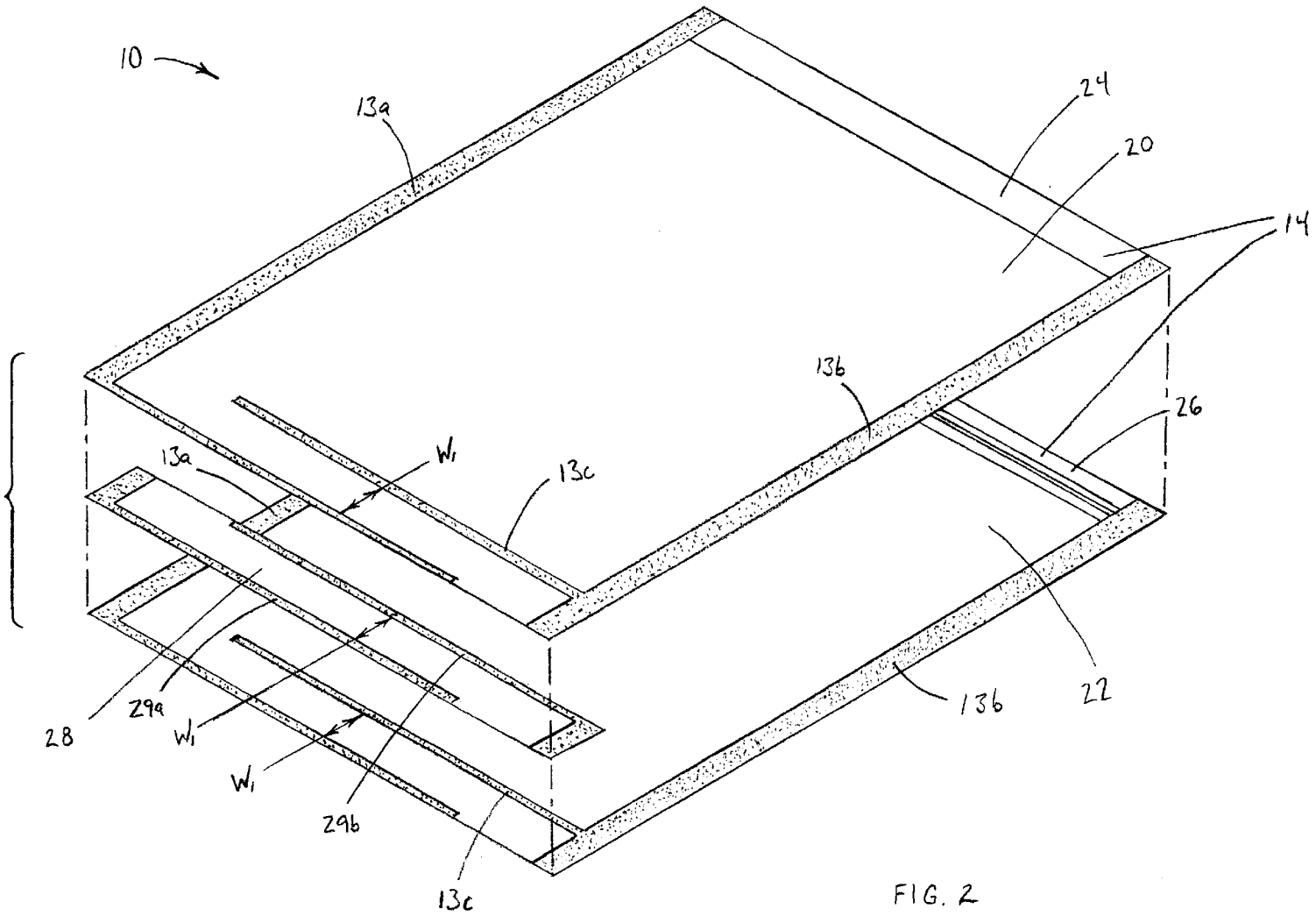
FIG. 2 is an exploded perspective view of an embodiment of the invention.

FIG. 2 is an exploded perspective view of bag 10. As shown, bag 10 includes a top sheet 20 and a bottom sheet 22. In one embodiment, sheets 20 and 22 are each a layer of conventional extruded low density polyethylene sandwiched between a conventional layer of nylon sheeting and a conventional layer of linear low density polyethylene. Other embodiments may use different material. As described above, sheets 20 and 22 are bonded along edges 13*a*, 13*b*, and 13*c*. In one embodiment bonding is done using conventional resistive heating. Other embodiments may use different bonding methods.

Bag 10 also includes top portion 24 and bottom portion 26 of airtight seal 14. Top portion 24 is bonded to top sheet 20 using conventional resistive heating. Similarly, bottom portion 26 is bonded to bottom sheet 22 using resistive heating. Other bonding methods may be used. In one embodiment seal 14 is a conventional interlocking resealable airtight fastener. The fastener is manufactured by MiniGrip ZIP-PAK, an ITW Company, with a marketing office located at 27001 La Plaz, Suite 400, Mission Viejo Calif. 92691. Other embodiments may use other airtight seals that are either resealable or permanent.

FIG. 2 shows valve strip 28 placed between top sheet 20 and bottom sheet 22. In one embodiment valve strip 28 is a single sheet of conventional blended low density polyethylene with high slip. Other embodiments may use different materials.

As shown, valve strip 28 is bonded between top sheet 20 and bottom sheet 22 along edges 29*a* and 29*b*. In one embodiment bonding is done using conventional resistive heating. Other embodiments may use different bonding methods. Valve strip 28 is positioned so that after bonding edges 29*a* and 29*b* two passageways are created. The top passageway is between top sheet 20 and valve strip 28. The bottom passageway is between bottom sheet 22 and valve strip 28. As shown, bonded side 29*b* of valve strip 28 is coincident with bonded bottom edges 13*c* of top sheet 20 and bottom sheet 22. In the embodiment shown, strip 28 extends from edge 13*a* to edge 13*b*. In other embodiments strip 28 may be shortened so as not to reach either or both edges 13*a* or 13*b*.

Referring again to FIG. 1, each unique top and bottom passageway 30*a* and 30*b* (hidden behind passageway 30*a*), respectively, has at one end an opening 31 into storage portion 12 and at the other end an opening 32 to the environment outside bag 10. In one embodiment each passageway has a width W1 of 1.00 inches. And in one embodiment the width W2 of openings 31 and 32 are each 1.50 inches. Other embodiments may use other dimensions for widths W1 and W2. The widths of openings 31 and 32 need not be identical.

Top sheet 20 and bottom sheet 22 normally contact the surface of valve strip 28 when no air or other substance (e.g., water) is in either passageway. When airtight seal 14 is closed and the pressure inside storage portion 12 is made greater than the ambient pressure, air passes through openings 31, travels along passageways 30*a* and 30*b*, and exits through openings 32. The ambient pressure then closes passageways 30*a* and 30*b* by pressing top sheet 20 and bottom sheet 22 against valve strip 28. Air is therefore prevented from returning to storage portion 12.

Figure 3A:
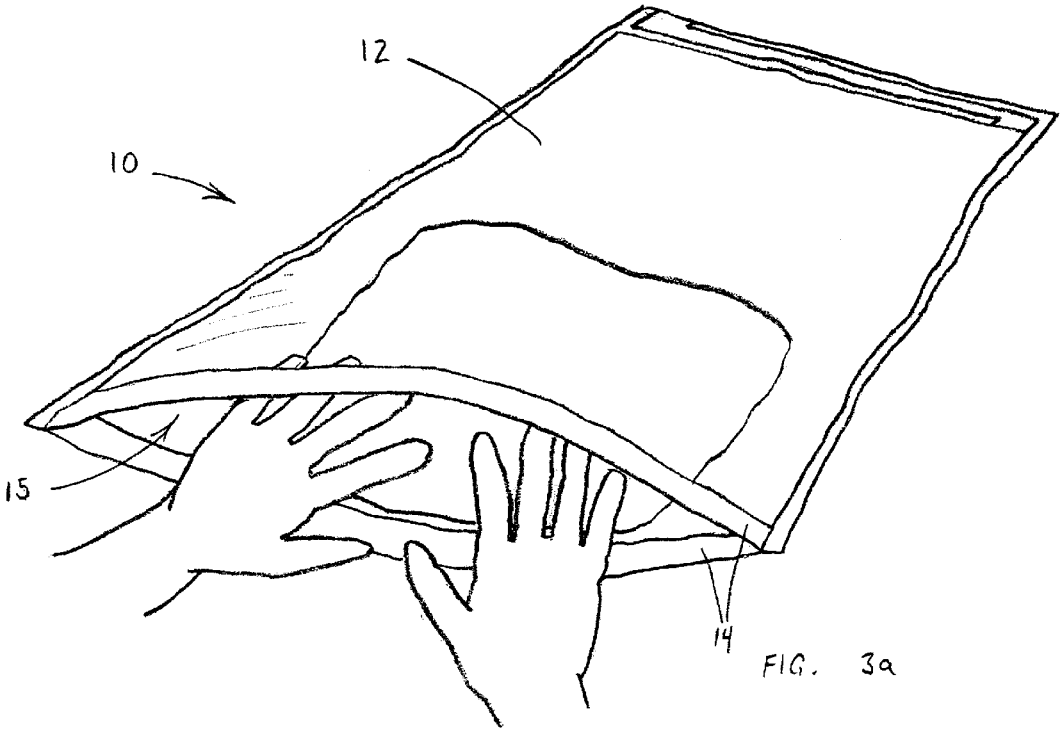
FIGS. 3*a*, 3*b*, and 3*c* are perspective views showing one method of using the invention.
Figure 3B:
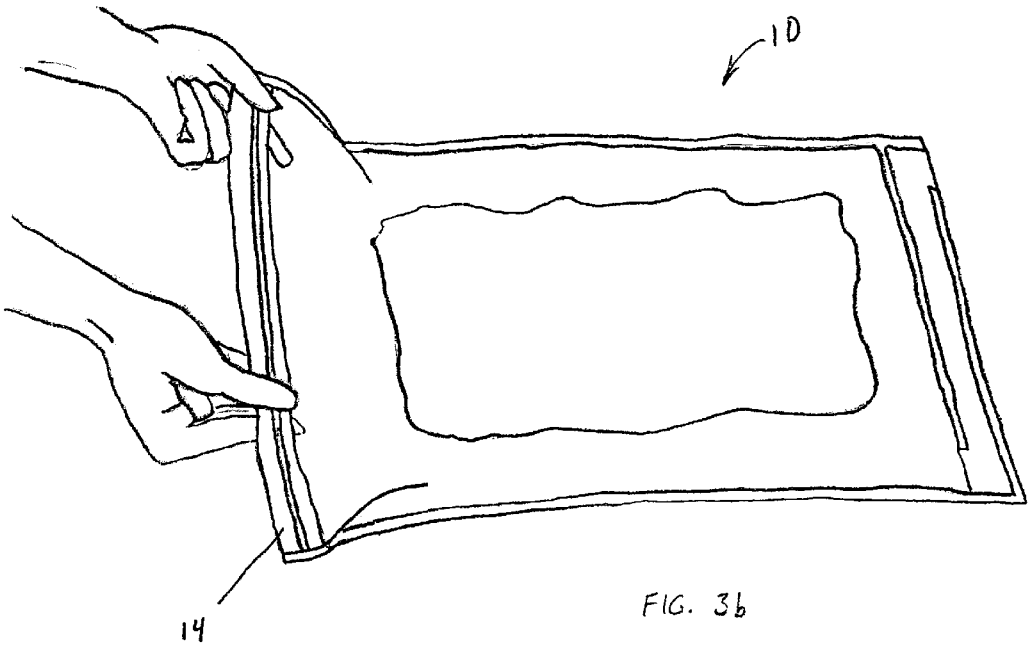
Figure 3C:
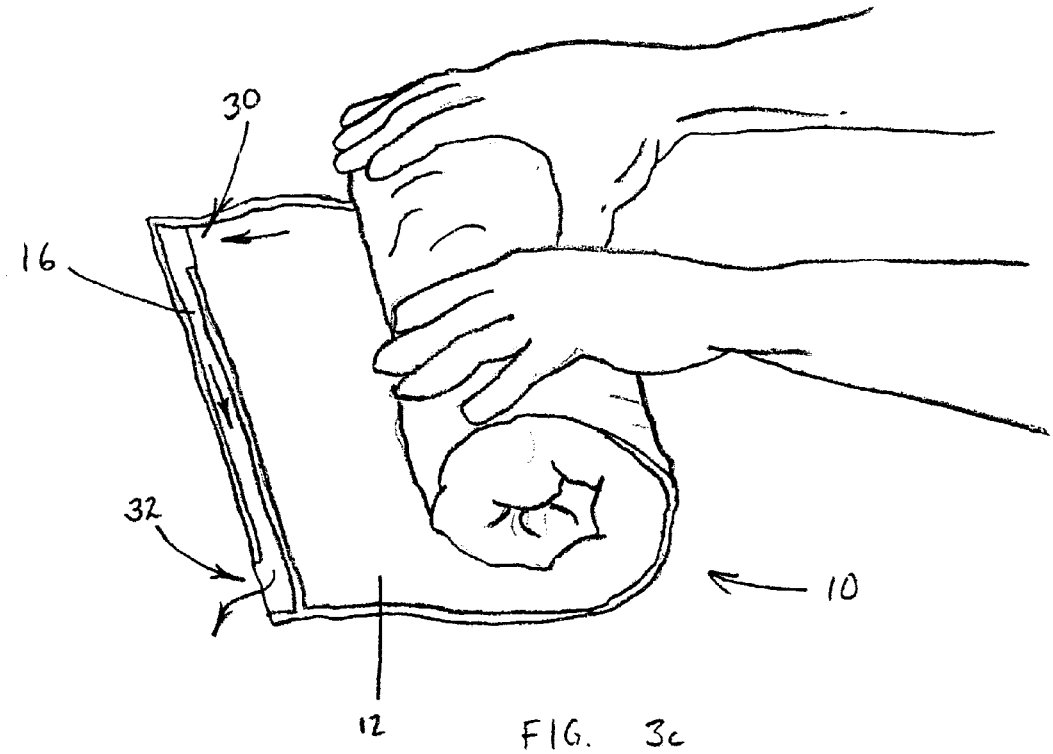

FIGS. 3*a*–3*c* illustrate one use of the present invention. As shown in FIG. 3*a*, a user opens seal 14 and places an item to be stored through opening 15 into storage portion 12. The user then closes bag 10 by making seal 14 airtight, as depicted in FIG. 3*b*. Next, the user expels air by rolling, beginning at an edge opposite valve 16, bag 10 towards valve 16. FIG. 3*c* shows that as the user rolls, air as represented by the arrows passes from storage portion 12 through openings 31, along the passages, and exits through openings 32. The user then unrolls the bag containing the stored item. Storage portion 12 remains partially evacuated and ambient air pressure prevents air from returning through the passages.

Figure 4:
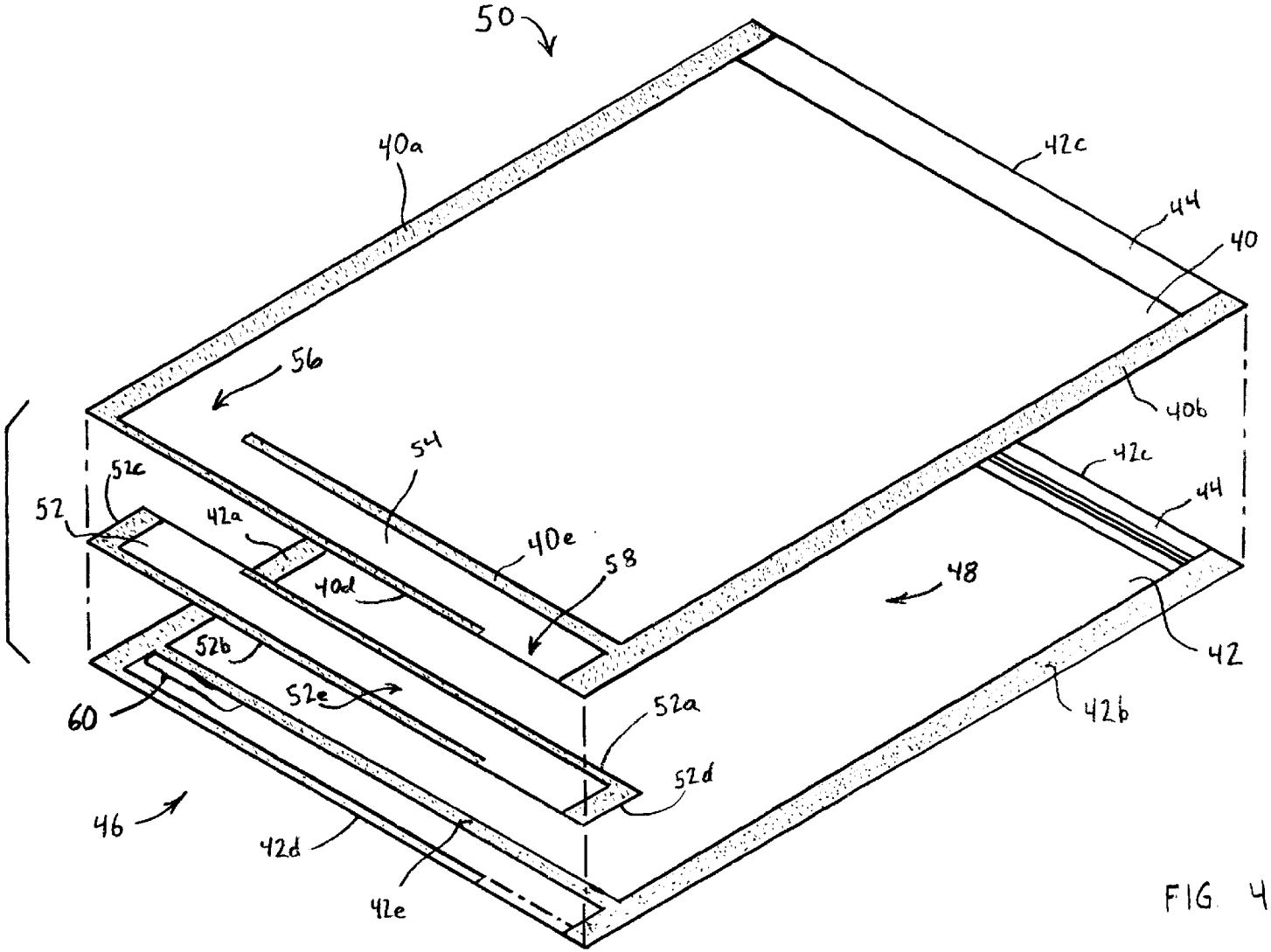
FIG. 4 is an exploded perspective view of a second embodiment of the invention.

FIG. 4 is an exploded perspective view of a second embodiment of the invention. The embodiment illustrated by FIG. 4 in many cases provides an improved one-way seal that prevents air, once evacuated, from returning to inside the storage bag. Top sheet 40 and bottom sheet 42 are bonded (e.g., using heat) along side edges 40*a*,42*a* and opposite side edges 40*b*,42*b*, respectively. The shaded portions in the drawings are illustrative of the bonded areas on sheets 40,42. A conventional resealable air-tight seal 44 (e.g., MiniGrip ZIP-PAK fastener) is bonded along top edges 40*c*,42*c* of sheets 40,42, respectively. One-way air valve 46 is formed at bottom edges 40*d*,42*d* of sheets 40,42, respectively. The area between sheets 40,42 that is encompassed by bonded edge pairs 40*a*,42*a*, 40*b*,42*b*, 40*c*,42*c*, and valve 46 forms storage portion 48 of evacuable storage bag 50. In one case sheets 40,42 each are made of an outer layer of biaxially oriented nylon and an inner (i.e., adjacent storage portion 48) layer of polyethylene, which acts as a good sealant layer. Other materials may be used for the outer layer, such as polyester or polypropylene. As described above, the user opens seal 44 and places an item to be stored into storage portion 48. The user then closes seal 44 and forces air from storage portion 48 through one-way valve 46.

As shown in FIG. 4, valve strip 52 is sandwiched between sheets 40,42 adjacent bottom edges 40*d*,42*d*, respectively. Valve strip 52 is rectangular and has long edges 52*a* and 52*b*, and short edges 52*c* and 52*d*. Edges 52*a*,52*b*,52*c*,52*d* encompass center portion 52*e* of valve strip 52. The shaded areas depicted on valve strip 52 are illustrative of the bonded areas (only the areas bonded to top sheet 40 are shown). As shown in FIG. 4, valve strip 52 extends the entire width of top and bottom sheets 40,42 between edge pairs 40*a*,42*a* and 40*b*,42*b*. In one case, valve strip 52 is a polyethylene strip, approximately 0.002 inches (2 mil) thick. Polyethylene sheets in contact with each other have good mutual surface attraction. Thus a good seal is provided between strip 52 and the inner polyethylene layer of top sheet 40. Other materials that provide a good mutual surface attraction may be used for valve strip 52 and the inner side of top sheet 40.

Valve strip 52 is bonded to bottom sheet 42 along the entire length of long edge 52*a*, as illustrated by bonding line 42*e* on bottom sheet 42 that is adjacent storage portion 48. Valve strip 52 is also bonded to bottom sheet 42 along short edges 52*c*,52*d*. In one case, valve strip 52 is bonded to bottom sheet 42 along a portion of long edge 52*b*, as illustrated in FIG. 4 by the shaded area extending partially along bottom edge 42*d* of sheet 42. In another case, valve strip 52 is bonded to bottom sheet 42 along the entire length of long edge 52*b*, as illustrated in FIG. 4 by the alternate position line extending along bottom edge 42*d*. The bonding between bottom sheet 42 and valve strip 52 is such that center portion 52*e* of valve strip 52 is not bonded to bottom sheet 42.

Valve strip 52 is also bonded to top sheet 40 along a portion of long edge 52*a*, as illustrated by bonding line 40*e* on top sheet 40. Valve strip 52 is also bonded to top sheet 40 along short edges 52*c* and 52*d*, and along a portion of long edge 52*b*. The bonding between top sheet 40 and valve strip 52 defines passageway 54 that extends from opening 56 into storage portion 48 to opening 58 that leads to the environment outside of bag 50.

In general, it has been determined that the effectiveness of the one-way seal along passageway 54 between valve strip 52 and top sheet 40 improves as the length of passageway 54 is increased and the width of passageway 54 is decreased. However, the width is made such that air being evacuated from storage portion 48 passes through passageway 54 without undue delay as the user rolls bag 50. In one case opening 56 is approximately 1⅜ inches wide and opening 58 is approximately 1⅝ inches wide. The width of passageway 54 is approximately 1⅛ inches and the length of passageway 54 from opening 56 to opening 58 is approximately 14¼ inches. The width of sheets 40,42 is approximately 18 inches.

Figure 5:
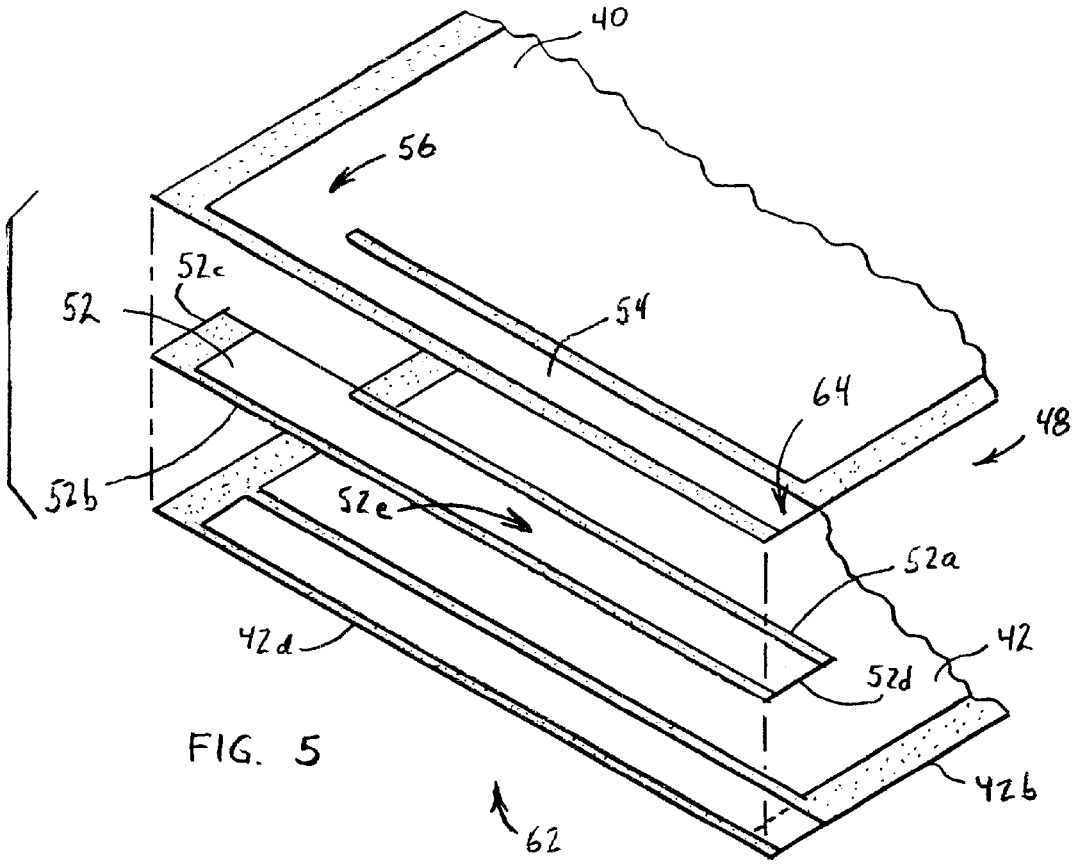
FIG. 5 is an exploded perspective view of a valve embodiment.

FIG. 5 is an exploded perspective view of another valve embodiment. As shown in FIG. 5, valve 62 is similar to valve 46 shown in FIG. 4, although only one short edge of valve strip 52 is bonded to top sheet 40. Thus the opening 64 that leads to the environment outside of the storage bag is differently oriented than opening 58 in FIG. 4. Valve strip 52 is bonded to bottom sheet 42 along the entire length of long edge 52*a* and along the entire length of long edge 52*b* (in another case, only a portion of long edge 52*b* is bonded to bottom sheet 42). As shown in FIG. 5, only one short side 52*c* is bonded to bottom sheet 42. In another case, both short sides 52*c*,52*d* are bonded to bottom sheet 42, as illustrated by the alternate position line extending along side 42*b* of bottom sheet 42. Center portion 52*e* of valve strip 52 remains unbonded to bottom sheet 42. Valve strip 52 is bonded to top sheet 40 along a portion of long edge 52*a*, the entire length of long edge 52*b*, and along short edge 52*c* so that passageway 54 extends from opening 56 into storage portion 48 to opening 64 that leads to the environment outside the bag at short edge 52*d*.

In one case bag 50 is manufactured by first bonding a portion of valve strip 52 to bottom sheet 42, and then bonding the strip 52 and sheet 42 combination to top sheet 40. A portion of long edge 52*a*, slightly wider than the width of opening 56, of valve strip 50 is first bonded to bottom sheet 42 as shown by area 60 in FIG. 4. Since valve strip 52 is thin, the bond is formed in one case using a seal head heated to approximately 270 degrees Fahrenheit. Then, the remaining bonds in bag 50 are formed using seal heads heated to approximately 350 degrees Fahrenheit. Other temperatures may be used in other cases. In another case bag 50 is manufactured by forming all bonds at once. A heat resistive material (e.g., TEFLON) (not shown) is placed between top sheet 40 and valve strip 52 where opening 56 is to be formed. Then, top sheet 40, valve strip 52, and bottom sheet 42 are-heat bonded together, and the heat resistive material is removed from opening 56.

Referring to FIGS. 4 and 5, a potential passageway between valve strip 52 and bottom sheet 42 that extends from storage portion 48 to outside the bag is blocked by bonding valve strip 52 to sheet 42 below opening 56 into storage portion 48 rather than below opening 58 (FIG. 4) or 64 (FIG. 5). It has been determined that if a passageway between valve strip 52 and bottom sheet 42 is sealed closest to the exit opening (e.g., near short edge 52*d*), that air being forced from storage portion 48 during evacuation tends to inflate the passageway between bottom sheet 42 and valve strip 52, thereby making it difficult to force air through passageway 54 between valve strip 52 and top sheet 40.

Persons skilled in the art will understand that many variations of the present invention are possible. The present invention is therefore limited only by the scope of the following claims.

I claim:

1. A storage bag comprising:

a top sheet;

a bottom sheet; and a valve strip, the valve strip comprising a first long edge, a second long edge opposite the first long edge, a first short edge, a second short edge opposite the first short edge, and a center portion encompassed by the long and short edges;

wherein the valve strip is bonded to the top sheet proximate a storage portion of the bag along a portion of the first long edge extending from the second short edge towards the first short edge, and along at least a portion of the second long edge extending from the first short edge towards the second short edge, the bonding between the valve strip and the top sheet defining a passageway extending from the storage portion of the bag to outside the bag; and wherein the valve strip is bonded to the bottom sheet along the entire first long edge.

2. The bag of claim 1, wherein the valve strip is bonded to the bottom sheet along the first short side and at least a portion of the second long edge.

3. The bag of claim 1, wherein the valve strip is bonded to the bottom sheet along the first short side and the entire second long edge.

4. The bag of claim 1 further comprising a resealable air-tight seal positioned to seal an opening into the storage portion.

5. The bag of claim 1, wherein the valve strip comprises polyethylene.

6. The bag of claim 1, wherein the top sheet comprises a layer of polyethylene against which the valve strip is bonded.

7. The bag of claim 1, wherein the top sheet comprises a layer against which the valve strip is bonded, the layer being the same material as the valve strip.

8. A method of manufacturing a storage bag, comprising the acts of:

providing a top sheet, a bottom sheet, and a valve strip, the valve strip comprising a first long edge, a second long edge opposite the first long edge, a first short edge, a second short edge opposite the first short edge, and a center portion encompassed by the long and short edges;

bonding the valve strip to the top sheet proximate a storage portion of the bag along a portion of the first long edge extending from the second short edge towards the first short edge, and along at least a portion of the second long edge extending from the first short edge towards the second short edge, the bonding between the valve strip and the top sheet defining a passageway extending from the storage portion of the bag to outside the bag; and bonding the valve strip to the bottom sheet along the entire first long edge.

9. The method of claim 8 further comprising bonding the valve strip to the bottom sheet along the first short edge and at least a portion of the second long edge.

10. The method of claim 8 further comprising bonding the valve strip to the bottom sheet along the first short edge and the entire second long edge.

11. The method of claim 8 further comprising positioning a resealable air-tight seal to close an opening into the storage portion.

12. The method of claim 8, wherein the valve strip comprises polyethylene.

13. The method of claim 8, wherein the top sheet comprises a layer of polyethylene against which the valve strip is bonded.

14. The method of claim 8, wherein the top sheet comprises a layer against which the valve strip is bonded, the layer being the same material as the valve strip.

* * * * *